US005170977A

United States Patent [19]

McMillan

[11] Patent Number: 5,170,977

[45] Date of Patent: Dec. 15, 1992

[54] CORNER BRACKET

[76] Inventor: Connie L. McMillan, 9823 Slee Rd., Onsted, Mich. 49265

[21] Appl. No.: 699,636

[22] Filed: May 14, 1991

[51] Int. Cl.[5] ..... E04B 1/38

[52] U.S. Cl. ..... 248/300; 52/712

[58] Field of Search ..... 248/300, 220.1, 200; 52/712, 715

[56] References Cited

U.S. PATENT DOCUMENTS

| | | | |
|---|---|---|---|
| 577,222 | 2/1897 | Wray | 248/220.1 |
| 1,704,883 | 3/1929 | Cullinan | 248/300 X |
| 1,920,520 | 8/1933 | Nord | 248/300 X |
| 2,638,643 | 5/1953 | Olson | 248/300 X |
| 2,704,868 | 3/1955 | Danielson | 52/715 X |
| 2,884,670 | 5/1959 | Garrison et al. | 248/300 X |
| 3,188,696 | 6/1965 | Earhart | 52/712 X |
| 3,256,030 | 6/1966 | Banse | 248/300 X |
| 3,345,029 | 10/1967 | Palmer | 248/300 |
| 3,669,480 | 6/1972 | Fugate | 248/300 X |
| 3,972,169 | 8/1976 | Sheppard, Jr. | 248/300 X |
| 4,238,900 | 8/1981 | Schubert | 52/712 |
| 4,313,688 | 2/1982 | Daniels | 52/712 X |
| 4,330,971 | 5/1982 | Auberger | 52/712 X |
| 4,572,695 | 2/1986 | Gilb | 248/300 X |

*Primary Examiner*—Carl D. Friedman
*Assistant Examiner*—Derek J. Berger
*Attorney, Agent, or Firm*—Leon Gilden

[57] ABSTRACT

A corner bracket includes a first, second, third, and fourth wall member, each arranged in accordion edge-to-edge relationship relative to one another oriented ninety degrees relative to one another, with an "L" shaped bracket mounted to the bottom edge of the first and second floor walls. The "L" shaped brackets define spaced gaps to receive base plates therebetween for securement to a corner post.

4 Claims, 4 Drawing Sheets

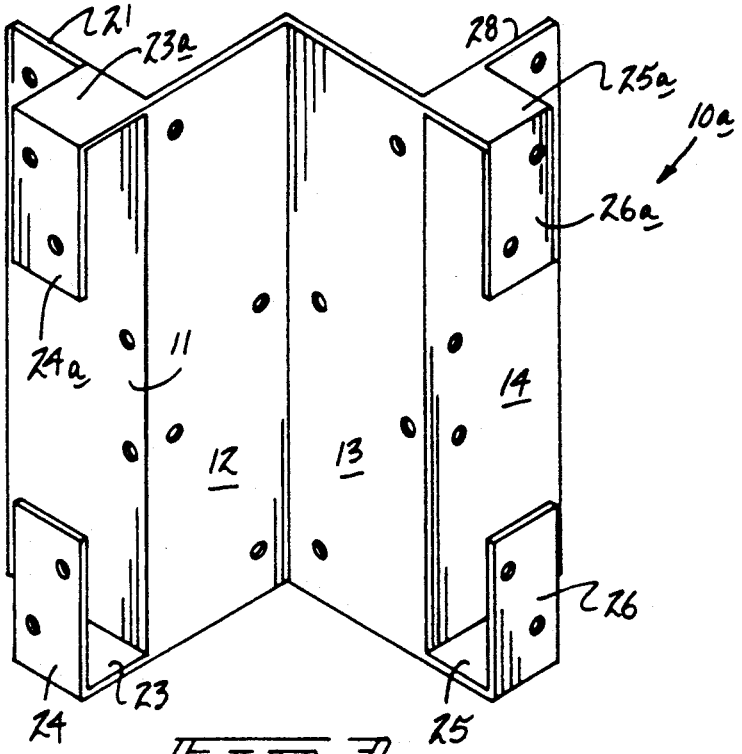
FIG 3
FIG 4
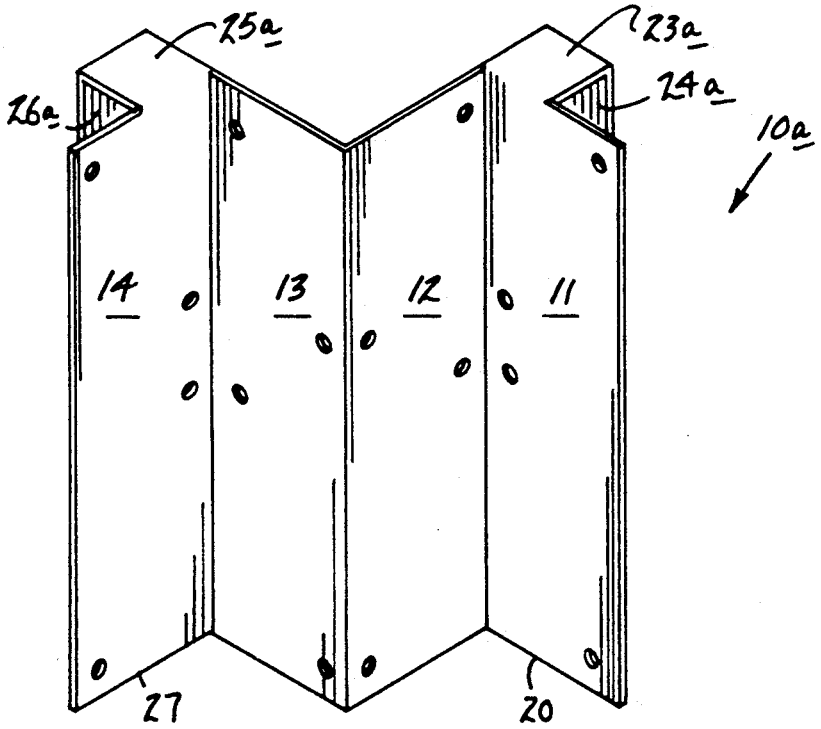

CORNER BRACKET

BACKGROUND OF THE INVENTION

1. Field of the Invention

The field of invention relates to bracket apparatus for use in construction, and more particularly pertains to a new and improved corner bracket wherein the same is arranged for mounting to a post member and positioning subsequent longitudinal plates for securement to the post member.

2. Description of the Prior Art

Bracket construction of various types are utilized in the prior art for assembling of various building components together. The corner bracket construction of the instant invention is arranged in a temporary or permanent member to maintain a plurality of plate members for securement to a centra post. Prior art construction type bracket apparatus is exemplified in U.S. Pat. No. 4,471,947 to Osborne wherein plate members include loops for securement of posts to planar plank members.

U.S. Pat. No. 4,280,686 to Wack sets forth a fence rolling connector including a plate for securement of longitudinal planks to vertical posts in an orthogonal relationship.

U.S. Pat. No. 4,359,851 to Daniels sets forth a bracket forming a central tube to receive a post therewithin.

U.S. Pat. No. 4,919,934 to Ott, et al. sets forth a rail construction bracket utilizing a central tube for receiving a post and a "U" shaped bracket contiguous thereto for receiving a plank in an orthogonal relationship relative to a post.

As such, it may be appreciated that there continues to be a need for a new and improved corner bracket as set forth by the instant invention which addresses both the problems of ease of use as well as effectiveness in construction in securement of a plurality of planks, wherein the planks are arranged in an orthogonal relationship relative to one another and to a central post.

SUMMARY OF THE INVENTION

In view of the foregoing disadvantages inherent in the known types of bracket apparatus now present in the prior art, the present invention provides a corner bracket wherein the same is fixedly secured to a central post and provides spaced gaps of longitudinal axes positioned at a ninety degree angle relative to one another. As such, the general purpose of the present invention, which will be described subsequently in greater detail, is to provide a new and improved corner bracket which has all the advantages of the prior art bracket apparatus and none of the disadvantages.

To attain this, the present invention provides a corner bracket including a first, second, third, and fourth wall member, each arranged in accordion edge-to-edge relationship relative to one another oriented ninety degrees relative to one another, with an "L" shaped bracket mounted to the bottom edge of the first and second floor walls. The "L" shaped brackets define spaced gaps to receive base plates therebetween for securement to a corner post.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved corner bracket which has all the advantages of the prior art bracket apparatus and none of the disadvantages.

It is another object of the present invention to provide a new and improved corner bracket which may be easily and efficiently manufactured and marketed.

It is a further object of the present invention to provide a new and improved corner bracket which is of a durable and reliable construction.

An even further object of the present invention is to provide a new and improved corner bracket which is susceptible of a low cost of manufacture with regard to both materials and labor, and which accordingly is then susceptible of low prices of sale to the consuming public, thereby making such corner brackets economically available to the buying public.

Still yet another object of the present invention is to provide a new and improved corner bracket which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 an isometric frontal view of a modification of the instant invention.

FIG. 4 an isometric rear view of the modification of the instant invention.

FIG. 7 an isometric illustration of the invention in use.

DESCRIPTION OF THE PREFERRED EMBODIMENT

Figures 1, 2:
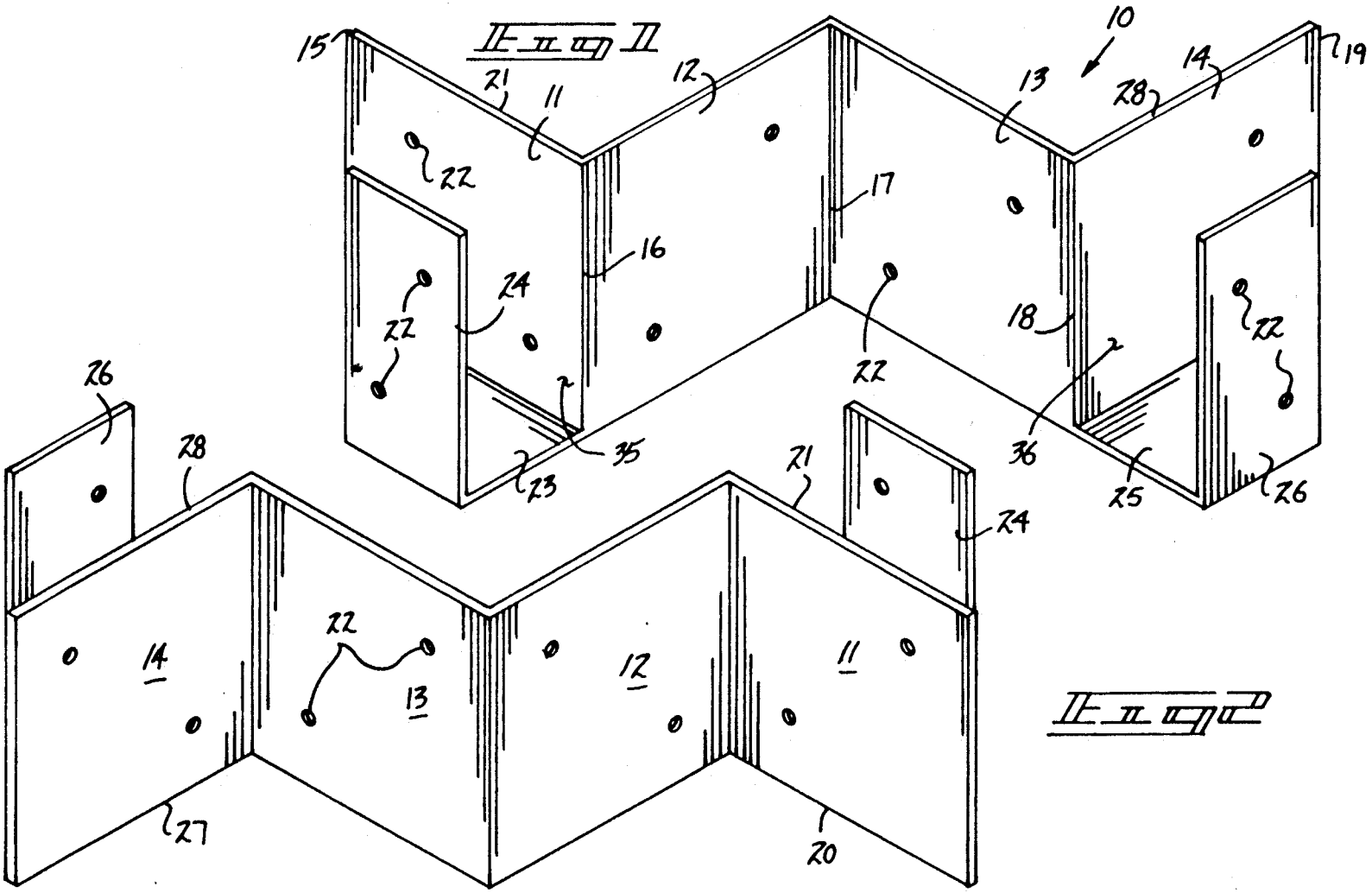
FIG. 1 an isometric illustration of the instant invention.
FIG. 2 an isometric rear view of the instant invention.

With reference now to the drawings, and in particular to FIGS. 1 to 7 thereof, a new and improved corner bracket embodying the principles and concepts of the present invention and generally designated by the reference numerals 10, 10*a*, and 10*b* will de described.

More specifically, the corner bracket 10 of the instant invention essentially comprises a planar first wall 11, including a first wall rear edge 15 and a first wall forward edge spaced from and parallel the first wall rear edge orthogonally mounted to a second wall rear edge at a first junction 16. The second wall 12 including a second wall forward wall is orthogonally mounted to a third wall 13 and a third wall rear edge at a second junction to orthogonally orient the second wall relative to the third wall. The third wall is orthogonally mounted to the fourth wall 14 at a third junction 18, wherein the fourth wall includes a fourth wall forward edge 19 that is spaced from and parallel the first wall rear edge 15. The first wall, second wall, third wall, and fourth wall define a "W" shaped configuration, as constructed and illustrated in FIGS. 1 and 2 for example. The first wall includes a first wall top edge 21 spaced from a first wall bottom edge 20. A first floor plate 23 is fixedly mounted to the first wall bottom edge 20, wherein the first floor plate 23 is orthogonally mounted relative to the first wall 11. The first floor plate 23 is fixedly and orthogonally mounted to a first floor plate wall 24, wherein the first floor plate wall 24 is spaced from and parallel the first wall 11 defining a first gap 35 (see FIG. 1). In a like manner, the fourth wall 14 includes a fourth wall bottom edge 27 and a fourth wall top edge 28. The fourth wall bottom edge integrally has mounted thereto a second floor plate 25 orthogonally oriented relative to the fourth wall 14, wherein the second floor plate 25 fixedly and orthogonally mounts a second floor plate wall 26 extending upwardly over the second floor plate 25 and oriented parallel relative to the fourth wall 14. A second gap 36 is thereby defined between the second floor plate wall 26 and the fourth wall 14. A first axis 37 (see FIG. 7) positioned medially of the first gap 35 and longitudinally thereof orthogonally intersects a second axis 38 that is medially and longitudinally oriented relative to the second gap 36. It should be noted that the walls 11–14 and the floor plate walls 24 and 26 each include a matrix of apertures 22 to receive fasteners such as wood screws, nails, and the like in securement of the bracket 10 to an associated structure, in a manner as illustrated in FIG. 7, to include a corner post 32 vertically oriented with a first and second respective board plate 33 and 34 received within the respective first and second gaps 35 and 36.

FIGS. 3 and 4 illustrate a modified apparatus 10*a*, wherein a further first floor plate 23*a* is fixedly mounted to the first wall top edge 21, with a further first floor plate wall 24*a* arranged colinear with the first floor plate 24. In a like manner, a further second floor plate 26 integrally mounted to the fourth wall top edge 28 orthogonally relative to the fourth wall 14 integrally includes a further second floor plate wall 26*a* colinear with the second floor plate wall 26. Accordingly, the structure may receive the first and second board plates 33 and 34 adjacent upper and lower edges of the first and second walls 11 and 14 in use.

Figures 5, 6:
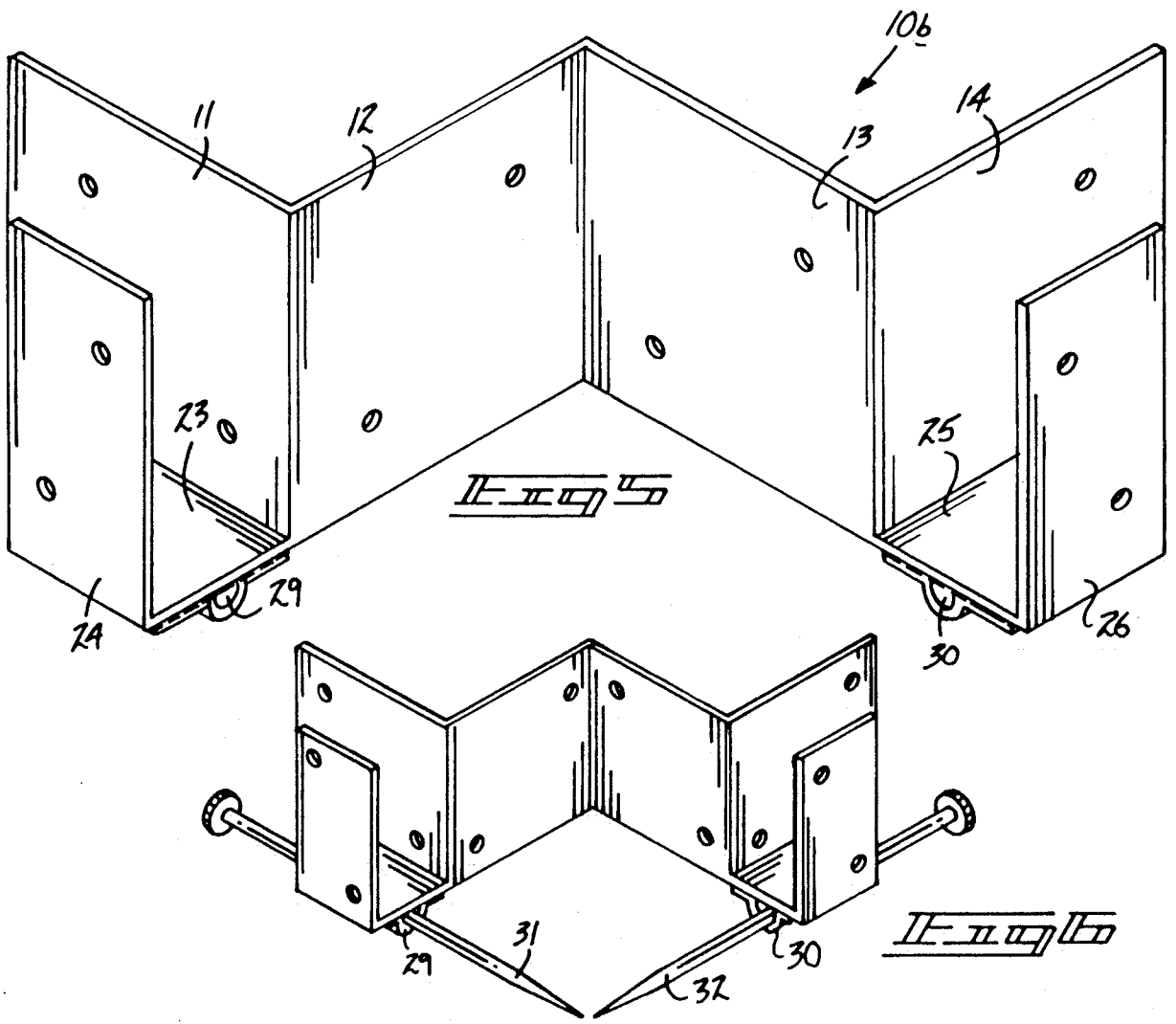
FIG. 5 an isometric frontal view of a further modification of the instant invention.
FIG. 6 is an isometric frontal view of the further modification mounting fastening means therethrough.
Figure 11:
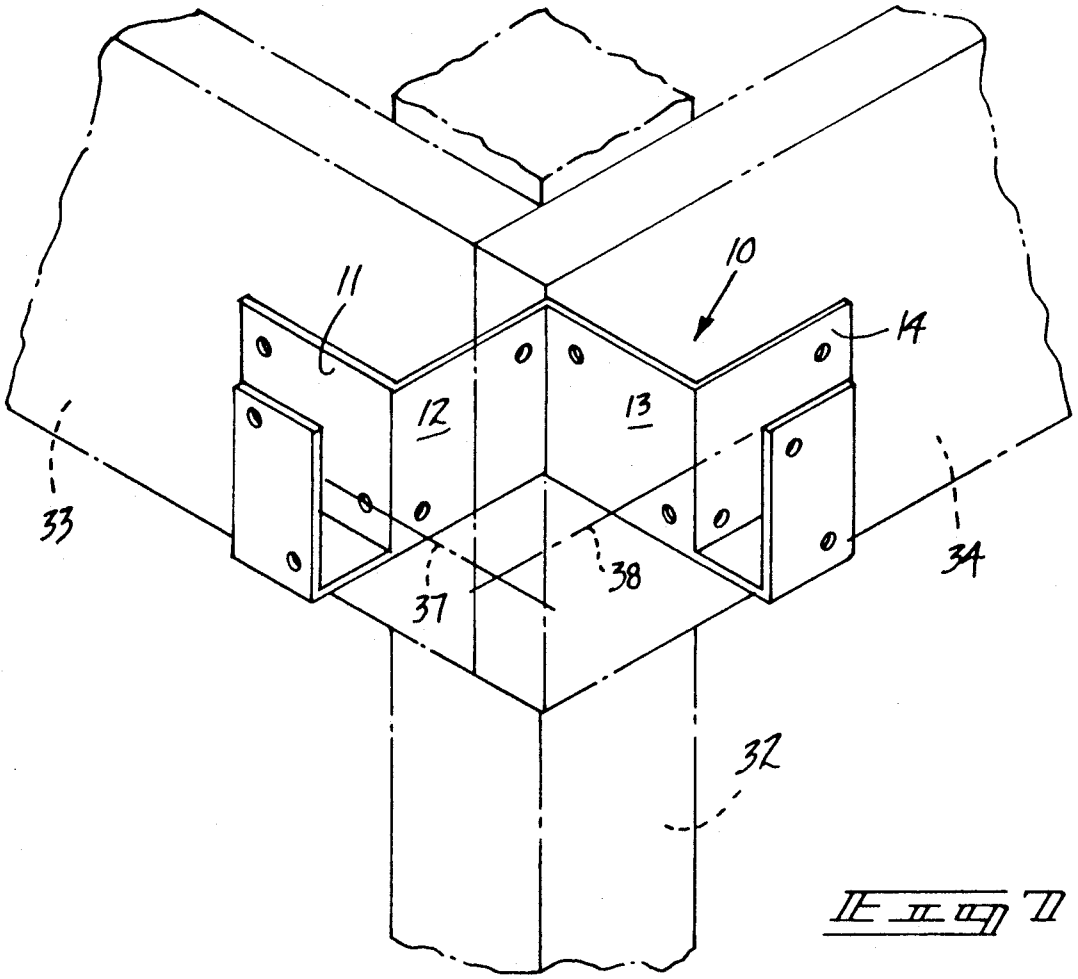

FIG. 5 illustrates the first floor plate 23 and the second floor plate 25, each including a respective first and second floor plate tube 29 and 30 respectively fixedly mounted to a bottom surface of each floor plate. Each tube accordingly may receive a fastener or securement member 31 therethrough, wherein access to the fasteners 31 and 32 are more readily available for preliminary securement of the bracket structure to the corner or vertical post 32.

As to the manner of usuage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A corner bracket, comprising, a first wall, a second wall, a third wall, and a fourth wall, the first wall including a first wall rear edge and a first wall forward edge, the second wall including a second wall rear edge and a second wall forward edge, the third wall including a third wall rear edge and forward edge, and the fourth wall including a fourth wall rear edge and a fourth wall forward edge, each respective forward edge and rear edge of each respective wall is arranged in a parallel relationship, and the first wall forward edge is integrally mounted to the second wall rear edge at a first junction, wherein the first wall is orthogonally oriented relative to the second wall, the second wall forward edge is fixedly mounted to the third wall rear edge to define a second junction, wherein the second wall is orthogonally mounted to the third wall, and the third wall forward edge is fixedly mounted to the fourth wall rear edge at a third junction, and the third wall is orthogonally oriented relative to the fourth wall, wherein the first, second, and third junctions are each arranged in a parallel coextensive relationship, and the first wall, second wall, third wall, and fourth wall define a "W" shaped configuration, and the first wall includes a first wall top edge and a first wall bottom edge, the first wall top edge and the first wall bottom edge arranged in a parallel spaced coextensive relationship, the fourth wall includes a fourth wall top edge and a fourth wall bottom edge, wherein the fourth wall top edge and the fourth wall bottom edge are arranged in a spaced parallel coextensive relationship, and the first wall bottom edge includes a first floor plate fixedly mounted to the first wall bottom edge, wherein the first floor plate is orthogonally oriented relative to the first wall, and the first floor plate includes a first floor plate wall fixedly mounted to the first floor plate and orthogonally oriented relative thereto, wherein the first floor plate wall is arranged parallel relative to the first wall to define a first gap therebetween, and the fourth wall bottom edge includes a second floor plate fixedly mounted thereto when the second floor plate is orthogonally oriented relative to the fourth wall, and the second floor plate includes a second floor plate wall integrally and orthogonally mounted to the second floor plate in a spaced parallel relationship relative to the fourth wall defining a second gap between the second floor plate wall and the fourth wall.

2. An apparatus as set fourth in claim 1 wherein each wall includes a matrix of apertures directed therethrough to receive fasteners.

3. An apparatus as set forth in claim 2 wherein the first floor plate includes a first floor bottom surface and the second floor plate includes a second floor plate bottom surface, the first floor plate bottom surface includes a first floor plate tube mounted thereto, the first floor plate tube is defined by a first tube access, and the second floor plate includes a second floor plate tube fixedly mounted to the second floor plate bottom surface, and the first gap includes a first gap axis medially and longitudinally positioned relative to the first gap, and the second gap includes a second gap axis medially and longitudinally oriented relative to the second gap, wherein the first gap axis and the second gap axis orthogonally intersect, and the first floor plate tube is arranged parallel relative to the first gap axis and the second floor plate tube is arranged parallel relative to the second gap axis, wherein the first floor plate tube and the second floor plate tube each receive a fastener therethrough.

4. An apparatus as set forth in claim 3 wherein the first wall top edge includes a further first floor plate, the further first floor plate oriented orthogonally relative to the first wall and arranged parallel relative to the first floor plate, and the further first floor plate includes a further first floor plate wall orthogonally oriented relative to the first floor plate parallel to the first wall and colinear with the first floor plate wall, amd the fourth wall includes a further second floor plate fixedly mounted to the fourth wall top edge, wherein the further second floor plate is oriented orthogonally relative to the fourth wall and the further second floor plate includes a further second floor plate wall oriented orthogonally relative to the further second floor plate and colinear with the second floor plate wall.

* * * * *